US007092668B2

(12) United States Patent
Behnke et al.

(10) Patent No.: US 7,092,668 B2
(45) Date of Patent: Aug. 15, 2006

(54) DEVICE AND PROCESS FOR HANDLING PRINTING MEDIA INSIDE A MICROWAVE MECHANISM

(75) Inventors: Knut Behnke, Flintbek (DE); Hans-Otto Krause, Eckernförde (DE); Frank-Michael Morgenweck, Molfsee (DE); Domingo Rohde, Kiel (DE); Detlef Schulze-Hagenest, Molfsee (DE); Lars Seimetz, Achterwehr (DE)

(73) Assignee: Eastman Kodak Company, Rochester, NY (US)

( * ) Notice: Subject to any disclaimer, the term of this patent is extended or adjusted under 35 U.S.C. 154(b) by 145 days.

(21) Appl. No.: 10/826,721

(22) Filed: Apr. 16, 2004

(65) Prior Publication Data

US 2004/0264987 A1 Dec. 30, 2004

(30) Foreign Application Priority Data

May 6, 2003 (DE) ..... 103 20 043

(51) Int. Cl.
*G03G 15/00* (2006.01)
*G03G 15/20* (2006.01)

(52) U.S. Cl. ..... 399/336; 399/92

(58) Field of Classification Search ..... 399/92, 399/335–338, 320

See application file for complete search history.

(56) References Cited

U.S. PATENT DOCUMENTS

2002/0191993 A1 12/2002 Bartscher et al.

FOREIGN PATENT DOCUMENTS

DE 10143988 A1 8/2002
JP 57097555 A 6/1982

*Primary Examiner*—Arthur T. Grimley
*Assistant Examiner*—Ryan Gleitz
(74) *Attorney, Agent, or Firm*—Lawrence P. Kessler

(57) ABSTRACT

Handling a printing medium in a microwave fuser mechanism of a printing machine so as to prevent damages and disruptions that can occur because of the presence of condensed water. The invention is achieved by removing moisture from the microwave mechanism and by, at least, supporting conveyance of the printing medium by flowing air, and also by preventing moisture from being conveyed into other parts of the microwave mechanism.

14 Claims, 5 Drawing Sheets

DEVICE AND PROCESS FOR HANDLING PRINTING MEDIA INSIDE A MICROWAVE MECHANISM

FIELD OF THE INVENTION

The invention pertains to handling a printing medium in a microwave mechanism, preferably in a microwave fuser mechanism in a printing machine.

BACKGROUND OF THE INVENTION

In electrophotographic printing machines, toner particles are transferred to a printing medium by an inking device. After the toner has been transferred onto the printing medium, the toner is fused onto the printing medium. In many electrophotographic printing machines, fusing is done inside a fuser mechanism by heat and pressure.

In U.S. Pat. No. 5,536,921, a microwave fuser mechanism is shown as being used for fusing toner. For this purpose, the travel path of the printing medium runs through the microwave fuser mechanism, whereby the toner and the printing medium are heated and the toner is thus fused onto the printing medium.

It is also conceivable that microwave mechanisms be used for the situation where, for example, a fuser mechanism with a fuser roller and a pressure drum is used. In such case, the microwave mechanism can, for example, preheat the printing medium and the toner so that fusing takes less time.

If a printing medium is conveyed through a microwave mechanism on a conveyor belt, the conveyor belt must be subjected to heightened requirements. The belt must absorb very little micro-radiation and have the least possible effect upon the microwave field. In addition, it must not conduct electricity.

Problems can arise even if a suitable conveyor belt that does not conduct electricity is used, in particular, when layers of toner are on both sides of the printing medium. This is the situation in duplex printing. The quality of the printed image can be adversely affected by direct contact of the layer of toner that is on the bottom of the printing medium with the conveyor belt.

An additional problem that arises during the fuser process performed by a microwave fuser mechanism or, in general, during handling of a printing medium inside a microwave mechanism, is the water vapor escaping from the printing medium. This water vapor can spread out inside the microwave mechanism. The conductivity of the gaseous mixture present inside the microwave mechanism increases when this happens. Consequently, arcing can occur inside the microwave mechanism. Such arcing can cause damage inside the microwave mechanism.

In addition, moisture can condense on the walls inside the microwave mechanism or on other components in the immediate vicinity. This can at least cause the microwave field to be distorted. An interruption of or in the operation of the microwave mechanism is at the least, likely.

SUMMARY OF THE INVENTION

The objective of the invention is therefore, to prevent damage and interruptions inside the microwave mechanism. In addition, it is an objective of the invention to improve the quality of the generated printed image. The objective of the invention is achieved in that moisture is removed from the microwave mechanism, and conveyance of the printing medium is at least supported by flowing air.

A microwave mechanism and/or a microwave fuser mechanism includes a source of microwaves in which the microwaves are generated, a wave guide in which the microwaves are transmitted, an applicator that includes the area through which the printing medium runs and in which a standing or a running microwave is generated, and an application area, which is the area inside the applicator in which the microwaves impinge upon a printing medium. This application area has a slot area that makes it possible for the printing medium to be conveyed through the application area. A special requirement for this slot area is that it prevents, to the greatest extent possible, the escape of microwaves through the slot area, which, in practice, connects the application area with the outer environment of the microwave mechanism. Consequently, the dimensions of the slot area are as small as possible.

In addition to arcing, condensed moisture inside the applicator can result in at least minor distortions of the microwave field. If moisture is removed from the microwave mechanism, in particular, from the application area of the microwave mechanism, the likelihood of arcing, which can result in damage to the microwave mechanism or the printing medium, is reduced. The subject invention anticipates removing the moisture with streams of air.

Generally, inside a printing machine a cooling mechanism is also present, downstream of a microwave mechanism. It assures that the printing medium and the toner are cooled down to a temperature where the toner will not smear when contacted. If the printing medium is conveyed with at least some support from flowing air, the need for the printing medium to make contact with points inside the microwave mechanism, in particular, inside the application area, will be removed. In such a case, conveyance elements would not be needed inside the microwave mechanism. In this way, smearing of a toner layer inside the microwave mechanism can be prevented. It is intended in accordance with the invention, that the same air be used to support conveyance of the printing medium as is used to remove moisture from the application area.

Supporting conveyance of the printing medium results in preventing the printing medium from becoming warped, particularly along its edges. Such warping can occur when the conveyance is not supported. The edges of the printing medium in particular, can begin to flutter and when the printing medium leaves the application area, the edges can bump against the walls of the application area or against a slot used to convey the printing medium through the application area. This can lead to a jamming inside the microwave mechanism. Support of the conveyance can also reduce the likelihood of such jamming.

In order to subsist without a conveyor belt inside the microwave mechanism, provision can beneficially be made for the conveying momentum to be transmitted to the printing medium through conveying elements located outside the microwave mechanism, whereby at least one conveying element is in constant contact with the printing medium. It is then sufficient inside the microwave mechanism, if the printing medium is held in a stable position through a stream of air. Accordingly, the layer of toner will not be smeared, because no contact is made with it inside the microwave mechanism. What is involved is essentially contact-free conveyance of the printing medium inside the microwave mechanism.

In particular, caution should be taken that the contact-free conveyance continues inside the cooling mechanism. The contact-free conveyance should be continued at least long enough for the temperature of the toner and the printing medium to fall below a crucial temperature of, for example, 70° C., below which the toner can no longer be easily smeared. However, support of the conveyance by an air stream is generally not necessary inside the cooling mechanism. No heightened requirements exist here, with respect to the slot area through which the printing medium is routed. Therefore, it can be configured, so that a jam-up of the printing media or contact inside the cooling mechanism is always precluded. Support of the conveyance by transport elements located outside the cooling mechanism, is then sufficient.

In a further development of the invention, it can be possible for the printing medium to be propelled by the flow of air. Contact with conveyor belts or similar devices in the vicinity of the microwave mechanism would no longer be necessary, and any risk that the toner could be smeared by contacts can be eliminated. Support of the conveyance by a stream of air is preferred from, however, since it is easier to achieve.

In a particular embodiment of the invention, the printing medium, is meant to be conveyed by conveying elements that convey the printing medium from below. Such an element can, for example, be a conveyor belt.

Provision can be made, in particular, for the printing medium to pass sequentially through two or more microwave mechanisms. The various applicators can, in such cases, be components of various microwave mechanisms and in each case, act upon different areas of the printing medium in that they are displaced one from another as is disclosed in DE 101 45 005 A1. The applicators and cooling mechanisms can then each be narrower than the width of the printing medium. Thus, guidance of the printing medium, by elements that are off to the side of the applicators and cooling elements can be made possible. The distance between the applicators should, in such cases, be enough to assure appropriate cooling of the toner and the printing medium by the cooling system. When being conveyed through a subsequent microwave mechanism, the printing medium can be conveyed, by those areas that have just passed through the previous microwave mechanism.

The printing medium runs through an application area of a microwave mechanism through a slot area that is encompassed by the application area. Because the printing medium contains moisture, water can get into at the least, the slot area by the printing medium. The goal of the invention is further achieved in that a flow of air out of the slot area and into the application area that encompasses the slot area is prevented. Since it is the printing medium itself that carries moisture into the inside of the microwave mechanism, it is especially beneficial that the air with which the printing medium has come into contact is prevented from penetrating further into the application area and/or the applicator. If such a result is prevented, arcing or distortion of the microwave field caused by condensed moisture on the walls of the applicator can be prevented.

In particular, provision is made for preventing air from flowing into areas outside the applicator. For example, other components such as attenuation elements, paper guiding elements, and/or chokes, or other components, can be present here. Here, too, problems can arise due to condensed moisture.

Provision is made in a particular embodiment of the invention, for the air to be heated before it flows into the microwave mechanism. The heated air can absorb a larger amount of water than cooler air. With heated air, more water vapor can be removed from the microwave mechanism, more efficiently. This will reduce the risk of arcing so that damage can be prevented. In addition, the microwave field inside the applicator will not be distorted by water. For example, provision can be made for the air temperature to be held at a maximum level. This level can be selected such that, no damage will be caused by the air and with the air flowing at a constant velocity, a maximal amount of moisture will be removed from the microwave mechanism.

In an embodiment, provision is made for the air to be heated through energy lost from the microwave mechanism. For this purpose, the stream of air can be directed to pass by an energy source of the microwave mechanism before it is applied to the printing medium. Energy efficiency can be improved by using the microwave mechanism supplementally for heating the air stream, since very little additional energy is required to heat the air. It can also be possible to use the waste heat from the microwave mechanism or other elements inside the printing machine to heat the air.

The microwave mechanism is a largely sealed off area inside the printing machine. If measures are to be taken against too much humidity inside the printing machine, difficulties will arise in determining in what way precisely which measures are to be taken and for how long. Consequently, provision is made from a practical standpoint to determine the moisture content inside the microwave mechanism, preferably in the vicinity of the travel path of the printing medium.

The determination of the condition inside the microwave mechanism can also be made indirectly by measuring the change in the condition inside the applicator relative changes in the humidity of the air coming out of the applicator. All that is needed, is to measure these changes outside of the application area. This way, any possible adverse effects upon the microwave field that might otherwise be caused by an internal measurement can be prevented. From the values that are to be determined, a determination can automatically be made as to what measures must be taken to reduce the humidity. For example, it is possible that in the event that a particular limit value is exceeded, the microwave mechanism would have to be stopped, because the danger of arcing would become too great due to the fact that not enough moisture is being removed.

Since the highest level of humidity must be expected to occur in the area of the travel path of the printing medium, i.e., in the vicinity of a printing medium that is being conveyed through the microwave mechanism, a particular embodiment provides that the moisture content of the air be determined in the vicinity of the travel path of the printing medium. In another embodiment, provision is made for the temperature of the air to be automatically adjusted, in particular, as a function of the moisture measured and the velocity of the air stream.

Warmer air can remove more moisture from the application area of the microwave mechanism. One can also achieve increased air removal by increasing the velocity of the air stream. Of course, the problem that not only a high temperature, but also a high air velocity, can adversely affect the microwave mechanism, the printing medium, and also the printed image exists. Thus, there must be limits in this regard. Since, maximal settings also mean higher energy use and lead to increased wear on affected mechanisms, it is particularly beneficial to coordinate their respective parameters, in particular, automatically, and as a function of the measured humidity. This way, optimal moisture content can be achieved with the least possible expenditure of energy and with minimal wear and tear.

Consequently, provision is also made according to the invention, for the velocity of the air stream to be adjusted automatically, in particular, as a function of the temperature of the air stream itself, the level of humidity measured, and the type and weight of the printing medium. Because printing media that have different weights require different air streams in order to assure a stable conveyance through the microwave mechanism, a consistently even conveyance at technologically feasible humidity levels can be made possible by taking the printing media's weight into consideration. Based upon the different characteristics of different types of printing media, two sequentially processed printing media can contain different levels of moisture and/or can release moisture into the atmosphere at different rates. In this regard, one must determine whether the printing medium in question is for instance, a foil, a sheet of paper, or a coated paper, or whether it is yet a different type of printing medium. With knowledge of these characteristics, one can ascertain the amount of moisture that one can expect to be required to remove and the velocities of the air stream can be adjusted accordingly, in order to assure a reasonable level of humidity inside the microwave mechanism.

In addition, the goal of the invention with respect to the apparatus, is achieved by a mechanism for generating and controlling an air stream that is used for reducing humidity inside the microwave mechanism and, for at least, supporting conveyance of the printing medium. The mechanism for generating and controlling an air stream assures contact-free conveyance of the printing medium through the microwave mechanism. Smearing of the toner layer on the printing medium by contacts, for example, with a conveyor belt, precisely when the toner is being heated inside the microwave mechanism, can thereby be prevented.

The mechanism can be configured so that the actual conveyance continues to be provided by paper conveying elements or propulsion elements that are outside the microwave mechanism. The paper conveying elements can be installed either above the microwave mechanism or below a cooling mechanism, which is located below the microwave mechanism, or they can be installed beside the microwave mechanism and the cooling mechanism, or both. The paper conveying elements can, for example, be conveyor rollers for rolls of paper, conveyor belts for sheets of paper, or even feeder mechanisms.

The mechanism can provide for reducing the humidity inside the microwave mechanism, so that moisture escaping from the printing medium or the toner layers is removed from the microwave mechanism. The air stream generated in accordance with the invention should be used for this purpose. The mechanism should, specifically, be capable of reacting to the various characteristics of the printing media, whereby parameters related to the air, as moisture content, and its temperature inside the microwave mechanism should, specifically be available for consideration. The mechanism can provide that the generated air stream additionally supports the conveyance of the printing medium inside the microwave mechanism, so that it remains stably in position.

The objective of the invention is additionally achieved by foil sheets that at least partially seal off the slot area used to convey the printing medium through the microwave mechanism from the remaining application area. Such sheets should preferably be made of a material that does not absorb microwaves, or only absorbs microwaves to a limited degree, and should preferably be installed in the area above or below the travel path of the printing medium. The printing medium is conveyed through this slot area. Air coming from this area absorbs moisture arising from the printing medium. The sheets can prevent this air from penetrating further into the application area. This can then prevent undesirable condensation on the walls of the applicator.

In a particular embodiment, the sheets do not fully seal off the application area. This makes it possible for air from this application area to flow into the slot area. Entry of moisture can be better prevented this way. In addition, this in-flowing air can absorb moisture even more quickly, and then carry the moisture out of the microwave mechanism. This air stream can supplementally support the conveyance of the printing medium. The aforementioned partial neutralization of the seal applied to the remaining application area can be achieved, for example, by perforations in the sheeting with air holes.

In particular, two or more applicators that are displaced from each other can be used to fuse the toner onto a printing medium. Additional components such as, chokes or attenuation elements, can be installed in the vicinity of these applicators to prevent microwaves from leaving the application area. The air that comes out of the application area will usually be heated and will contain a certain amount of moisture. Outside of the application area, the air will cool off and water can condense on components located outside the application area. This condensed water can consequently cause faulty operation of these components. For example, the attenuating characteristics can be adversely affected. Consequently, in a further development of the invention, provision is made, going beyond the application, for the sheets to at least partially seal an area including the application area. Inside this area, the above-mentioned components, such as, chokes or attenuating elements can then be installed. This area can also include the entire area inside the printing machine where applicators are located to melt toner on printing media. Subsequently, provision can be made, specifically, for the use of only two sheets for partially sealing the slot areas of all applicators. As a result, fewer sheets need to be used, and without water being able to condense on components to their detriment, the air will remove the moisture from the entire area in which microwaves act upon the printing medium.

In a further embodiment, the sheets according to the invention are perforated. Then, in a particularly beneficial way, they have tiny air holes that are evenly distributed. As a result, an air stream can be generated that: (1) acts upon the printing medium from the application area that is screened off by sheeting, and (2) then passes through the perforations. This way, a very even stream of air that flows in only one direction can arise. Both the support for conveying the printing medium and the prevention of moisture entry into the applicator can be improved. The perforated sheets also assure in a practical way that coarse impurities and particles, as well as other gaseous impurities, do not leave the direct vicinity of the printing medium and therefore cannot penetrate into the application area. These particles and impurities are conducted out of the application area through the slots through which the printing medium is conveyed.

In practice, the application area, for example, can include an upper and a lower application area. In an area of high field strength, these two areas can be separated from one another by the slot area. The printing medium can then be conveyed through this slot area. Inside the area, between the two application areas, the printing medium is subjected to the microwave field and the toner can be fused onto the printing medium. Then according to the invention, the two application areas can be separated from the slot area through the perforated sheets and can also encompass the slot area.

Specifically, areas of the microwave mechanism that lie outside the applicators can also be protected from water, impurities and other particles by the sheets. For this purpose, the sheets can be extended beyond the application area. This area outside the application area, the sheets then need not be perforated. The sheets should preferably be made of PTFE, currently a good, easily handled material that only minimally absorbs microwaves and with the proper thickness, only slightly distorts the microwave field. In accordance with the invention, the PTFE sheets should preferably be between 0.05 mm and 1.00 mm thick.

In another embodiment, provision is made for the mechanism to incorporate air inlet boxes, preferably under and above the application area. These air inlet boxes are beneficial in that the air is not blown directly through the perforated sheeting by fans. The air can further be pretreated. In particular, it is possible for the air stream to extend into the application area at an even velocity over a wider area. Further treatment of the air inside the air inlet boxes or during the intake of the air into these boxes, includes air cleaning. The air inlet boxes can be such that they are incorporated into the microwave mechanism.

In another embodiment, provision is made according to the invention, for the walls of the application area to have air inlet openings. These holes can be in the form of slits or circles. These air inlet openings can be used to assure an air stream that leads to a stable and even flow of air in the area of the travel path of the printing medium by the perforated sheets. To achieve this purpose, the air inlet openings, in particular, should be evenly shaped and arranged.

In order for the microwave mechanism inside the application area to not be adversely affected by the air inlet openings, provision is made for the openings to have a geometry suited to preventing the reflection of microwave radiation in an especially beneficial embodiment. In experiments, a beneficial embodiment of the air inlet openings was found to include a slitting structure where the slits were directed crossways to the microwaves' direction of dissemination. The width of a slit should be in the range of 2 mm to 3 mm. Circular holes with a diameter of about 2 mm to 3 mm, can also be used.

The air inlet openings are such that they assure an adequate air stream, while at the same time they prevent reflection of the microwave field that is present inside the applicator to the greatest extent possible. The air inlet openings are helpful by generating an essentially uniform flow of air upstream, while the perforated sheets that are located downstream, generate a homogeneous flow.

It is also possible for the air inlet boxes not to be located directly above or below the travel path. For example, an air inlet box could be offset below or above the travel path, i.e., off to the side of the travel path.

When a printing medium is conveyed through the application area, a flow of air is generated that passes through the perforated sheets located above and below the travel path of the printing medium. This air stream is intended to assure that the printing medium is conveyed in a stable manner. However, the air stream can veer off into areas of the applicator that lie outside the travel path of the printing medium. The different currents from below, and from above, are no longer separated from one another by the printing medium. This can result in that the air streams becoming short-circuited, which can preclude stable conveyance of the printing medium.

Therefore, provision has been made for air barriers, preferably made of PTFE, which will separate the area of the travel path inside the application area from the remaining areas of the applicator. Thus, an aerodynamic short circuit ideally, can be prevented. The applicator, for example, connects on one side to an inlet panel over which microwaves are fed out of a wave guide into the applicator. On the other side of the applicator, an adjustable, a moveable slide valve can be supplementally placed so that appropriate resonance conditions for the microwave can be created inside the applicator, allowing formation of a standing wave. Thus, the application area will lie between the slide valve and the inlet panel. These air barriers can then prevent the occurrence of an aerodynamic short circuit via the remaining applicator area, and in addition, contamination of this area of the applicator and of the wave guide can be prevented. In the event that one standing microwave is being used, of course, no inlet panel will be present. Nevertheless, a distinction can be made between an applicator, an application area, and a wave guide, that guides the microwave to the applicator. Here too, both a short circuit and contamination can optimally be prevented by air barriers.

In some embodiments of a microwave mechanism, provision can be made for a supplemental dielectric load to be located inside the microwave mechanism. This load can be moveable and can be used to adapt the microwave output that acts upon the printing medium to the characteristics of the printing medium. Such characteristics, for example, can include the type of printing medium, i.e., whether it is a foil, a sheet paper, a roll of paper, or another type, the weight of the printing medium, and/or the moisture content of the printing medium. This dielectric load is usually located in an area where the field strength is low, and can be moved into an area where the field strength is higher.

The source of microwaves for a microwave mechanism, for example, can be set to a particular frequency. The resonance conditions inside a resonant applicator should therefore be adjusted for this frequency. However, since the resonance conditions change when printing media are inserted, provision is made for the dielectric load to be beneficially moved into areas of either higher or lower field strength such that the resonance conditions inside the applicator will again match the original frequency. The flow of air can be deflected or cut off by this dielectric load. Therefore, for practical reasons, provision is made according to the invention for the dielectric load to have air passage holes, so that air can pass through the load. The flow of air can then pass through these air passage holes, without adversely affecting the flow of air. Beneficially, these air passage holes do not need to meet any heightened requirements.

Air passage holes in the dielectric load, however, are not absolutely required. A moisture-measuring device is provided in the vicinity of the microwave mechanism to determine the moisture content inside the microwave mechanism. This device for measuring moisture can be located in the vicinity of a slot through which the printing medium is conveyed, for example. With this device, a determination as to whether moisture that forms inside the microwave mechanism is being adequately removed by the flow of air can be made, according to the invention.

For such a determination, it is sufficient that a change in the amount of moisture be detected. Consequently, the requirements that must be met by the moisture-measuring device are low, according to the invention. When the microwave mechanism is inactive, and ideally no printing medium is located therein, the level of moisture inside the mechanism should be low. This level can then be used for detecting a relative change in the level of moisture. Thus, the microwave mechanism is in use and a printing medium is located therein, a relative change in moisture can be detected, and if it is above a particular value, processes can be commenced for reducing the moisture level, or the machine can be turned off.

The moisture-measuring device must include at least two electrodes in a particular embodiment, according to the invention. These electrodes can be located on a nonconductive surface where they are next to each another, but separated from one another, so that no contact is made between them. According to the invention provision is made for perforated sheets to be used for this purpose. These sheets can extend into the slot used for conveying the printing medium, and according to the invention, they can even extend beyond the slot. The electrodes should then be installed as close as possible within the vicinity of the application area, but not so close as to extend into the microwave field inside the application area. The slot itself has proven to be in a particularly beneficial location. The electrodes can be attached to the sheets that are installed inside the slot. Of course, it would be possible to attach the electrodes to another nonconductive surface.

Once this is done, voltage pulses can be applied to the electrodes. When there is no moisture between the electrodes, no measurable current will flow between the electrodes. The measurement should preferably be made with the use of high voltage pulses that have been applied to the electrodes.

If a sufficient amount of moisture is present inside the applicator, a conductive layer of condensed water will form between the electrodes. The conductivity of this layer is a function of the amount of moisture. An evaluation of the current flow between the electrodes will provide a qualitative measurement of the change in moisture level, and can be used to determine the relative change in moisture level inside the microwave mechanism.

This measurement, made via the electrodes, uses an indirect measurement process. The level of moisture inside the applicator cannot directly be determined. However, water can condense between the electrodes. This condensed water will form only a thin film that will be limitedly conductive, because the water is distilled. Consequently, high voltage pulses are particularly well suited for detecting changes in the amount of condensed water. By measuring a current that flows between these electrodes, conclusions can be drawn with respect to the condition of the system inside the applicator.

In addition, care must be taken that neither the evaluation of the measured current nor the electronic evaluation device itself is adversely affected by the microwave radiation. In this regard, it is possible to select components that are appropriately microwave resistant, to select a location for the electronic evaluation device that is subjected only to low levels of microwave radiation and/or to select an electronic filtering system for avoiding faulty evaluation caused by microwave radiation coupled into the measuring setup.

The amount of moisture that is removed from the microwave mechanism by the flow of air is a function of the air's capacity to absorb the moisture. Since the absorption capacity of the air is a function of the temperature of the air, at least one pre-heating mechanism is beneficially provided for heating the incoming air. The air that has been warmed in this manner can absorb more moisture, whereby removal of moisture from the microwave mechanism is enhanced.

This preheating mechanism can be such that it uses the waste heat from the microwave source to heat up the air stream, according to the invention. The preheating mechanism, for example, can be located in an area that is upstream of air inlet boxes that may be present, or it can actually be inside such air inlet boxes.

In addition, the objective of the invention is achieved through a microwave mechanism with a ventilation mechanism with, in at least one application area, integrated air channels with air outlet openings for guiding the flow of air into a travel path for a printing medium that runs through the microwave mechanism.

The microwave radiation is directed through a wave guide. The wave guide opens into an application area inside of which the microwave radiation acts upon the printing medium and the toner layer. Resonant conditions for the microwave radiation must prevail inside the applicator. For this purpose, a slide valve can be located in a sealed area of the applicator.

However, applications are also possible, where no resonant conditions prevail and where a standing microwave is formed.

A printing medium can be conveyed through the application area through a slot contained in the application area. Subsequently, the printing medium runs through a cooling mechanism where its temperature is lowered to a point where the toner firms up enough so that the printing medium can again be conveyed by traditional conveying elements, without adversely affecting the printed image located thereon. Outside the microwave mechanism and the cooling mechanism, the printing medium is conveyed by conveying elements such as conveyor belts, gripper systems, or conveying rollers.

Because of the heating, water vapor is created inside the microwave mechanism. The vapor is released by the printing medium when the water inside the printing medium is heated. This water vapor can cause arcing, especially when it condenses and appears as water on a wall of the applicator. Consequently, provision has been made according to the invention, for the microwave mechanism to have a ventilation mechanism. With this mechanism, moisture can be beneficially removed form the inside of the microwave mechanism.

For this purpose, provision is made for at least one application area to have integrated air channels through which streams of air are directed. Therefore, these air channels must incorporate air outlet openings to be used for directing the flow of air. This way, a uniform flow of air can be directed into a printing medium travel path that runs through the microwave mechanism. Moisture can be removed from the application area through this flow of air.

The flow of air can also beneficially assure a contact-free, stable conveyance of the printing medium inside the microwave mechanism. Thus, layers of toner will not be adversely affected by contacts with components, conveyor belts, or the like. An increase in the quality of the printed medium that has been created can therefore be achieved. In addition, jamming of the printing media that would otherwise result from unstable conveyance can be avoided.

In addition, the objective of the invention is achieved by a microwave mechanism in which the travel path is encompassed by PTFE sheets that to a large extent, at least, cover the travel path. These sheets can prevent moisture from being carried into the application area, which in turn, will prevent moisture-induced arcing or distortion of the microwave field caused by condensed moisture.

PTFE sheets that do not completely cover the travel path also provide possible ventilation for the slot area that incorporates the travel path. This ventilation can come from the direction of the application area and the flow of air can prevent moisture from being conveyed into the application area or into the applicator. In addition, the ventilation can support conveyance of the printing medium.

The PTFE sheets should preferably not be limited to the area directly inside the applicators, i.e., to the area of the application areas that are separated by the travel path. That is, they can also extend beyond the application areas and for example protect from condensed moisture elements, are located, for example, in the vicinity of the applicator. Among such elements, for example, chokes, which are to prevent, or at least minimize the escape, of microwave radiation.

In an embodiment of the microwave according to the invention, provision is made for the PTFE sheets to be perforated. This allows a flow of air to evenly impinge against the printing medium, so that the removal of moisture from the microwave mechanism by this air can be even further improved. In addition, a more uniform support of conveyance of the printing medium inside the application area can beneficially be achieved.

Provision is beneficially made for the walls of the application area to have air inlet openings. An initial flow of air can be directed through the air inlet openings into the inside of the microwave mechanism. The walls of the application area, in particular, can abut on air inlet boxes, according to the invention. Furthermore, the air inlet openings can be laid out so that reflection of the microwave output is minimized. In this regard, openings that are shaped as slits or circles, for example, are conceivable. The initial flow of air that is generated through the air inlet openings on the walls of the application area can flow more evenly toward the PTFE sheets, and therefore, a uniform and stable flow of air in the area of the travel path can be ascertained.

In another embodiment of the microwave mechanism, a device for measuring moisture is located in the vicinity of the travel path. With this device, at least a relative change in the level of moisture inside the microwave mechanism can be detected. Beneficially, such a change can be positively reacted to, preferably automatically through of an increase in the temperature of the air, and/or an increase in the velocity of the air flows. Consequently, a preheating mechanism is provided according to the invention, that will increase the temperature of the air in the air streams, so that the air streams can absorb a larger quantity of moisture and carry it out of the microwave.

BRIEF DESCRIPTION OF THE DRAWINGS

Embodiments from which additional characteristics can result, according to the invention, to which, however, the scope of the invention is not limited, are shown in the following drawings in which.

DETAILED DESCRIPTION OF THE INVENTION

Figure 1:
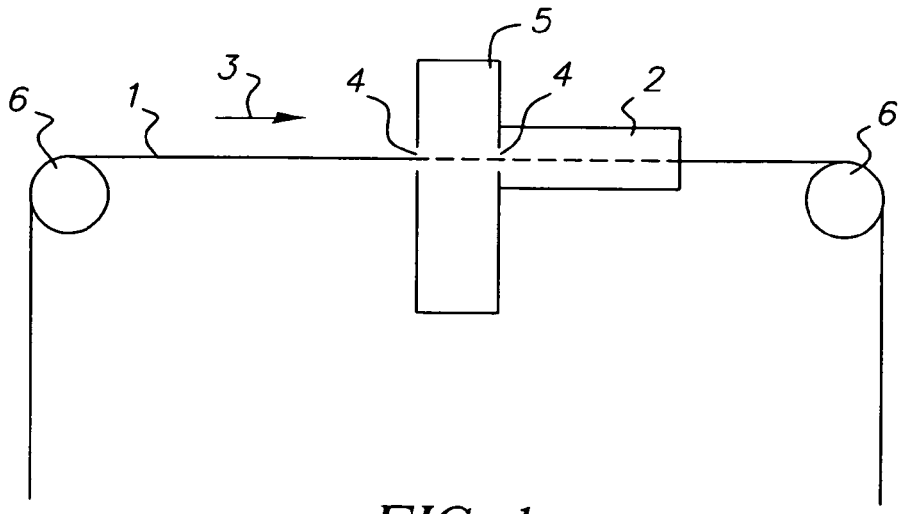
FIG. 1 is a side view of a microwave mechanism for a rolled paper track.

FIG. 1 is a side view of a microwave mechanism 5. This microwave mechanism is a microwave fuser mechanism, inside of which toner is fused onto the printing medium 1. The microwave mechanism 5 is located inside a printing machine that is not shown here. The printing medium 1, used in this example, is roll paper.

The printing medium 1 is conveyed through the microwave mechanism 5 in the direction of the arrow 3. For this purpose, the printing medium 1 is carried over conveying spaced rollers 6. The printing medium is fed into the microwave mechanism through a paper slot 4. After passing through the microwave mechanism 5, in which, for example, existing toner is fused onto the printing medium, the printing medium 1 is conveyed around the downstream conveying roller. For this purpose, the printing medium leaves the microwave mechanism 5 through a second paper slot 4.

After leaving the microwave mechanism 5, the printing medium 1 runs through a cooling mechanism 2. The openings through which the printing medium 1 passes can be of almost any kind, as long as there is no danger that the printing medium 1 will come into contact with the edges of these openings, even when the printing medium is severely out of position.

Figure 2:
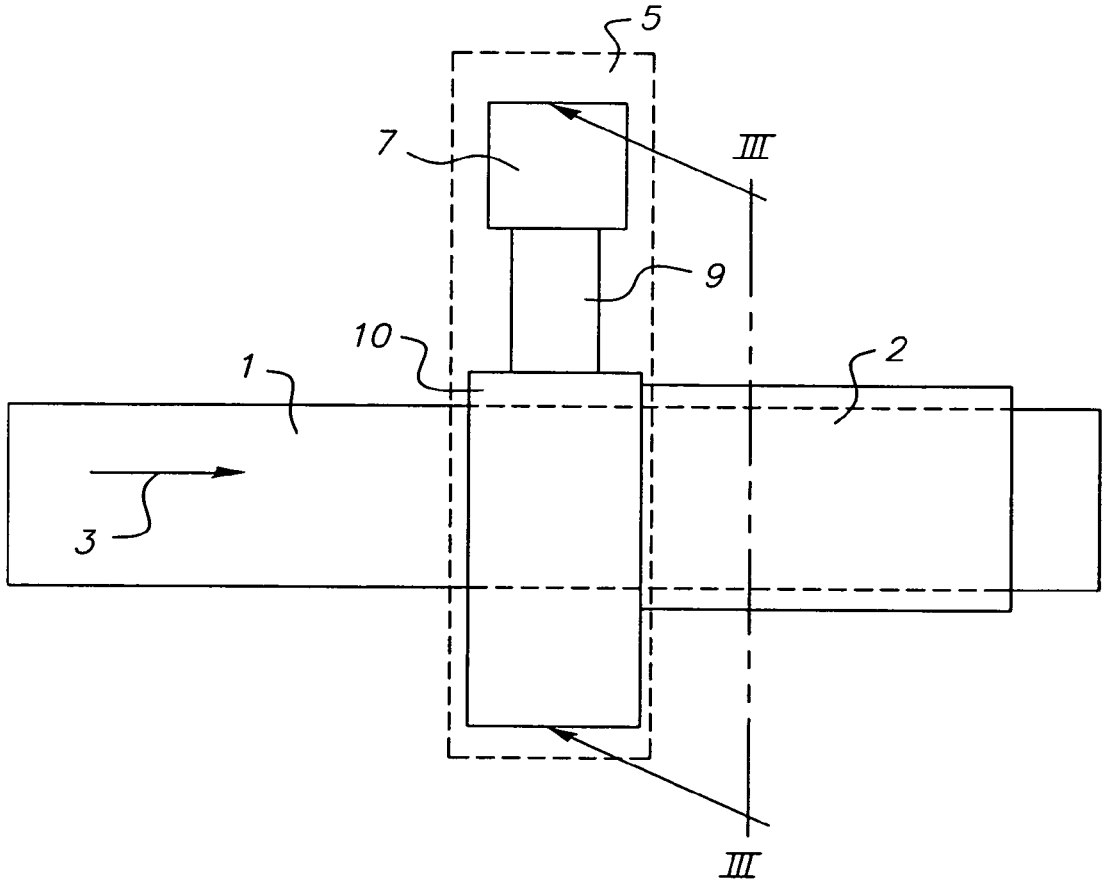
FIG. 2 is an overhead view of a microwave mechanism similar to the one shown in FIG. 1.

The representation of a microwave mechanism 5, in FIG. 1, is shown from overhead in FIG. 2. The printing medium is being conveyed in the direction of the arrow 3 and is being fed into the microwave mechanism 5. The microwave mechanism 5 includes of a source of microwaves 7, which generates microwaves that are transmitted through a wave guide 9 into an inner space 10 of the microwave mechanism 5. The inner space 10 contains an application area 17 that can be seen in FIG. 3.

The invention, however, is not limited to microwave mechanisms 5 that have appropriate resonance conditions. Other microwave mechanisms are possible that do not need to meet resonance conditions and in which a standing microwave is formed.

Figure 3:
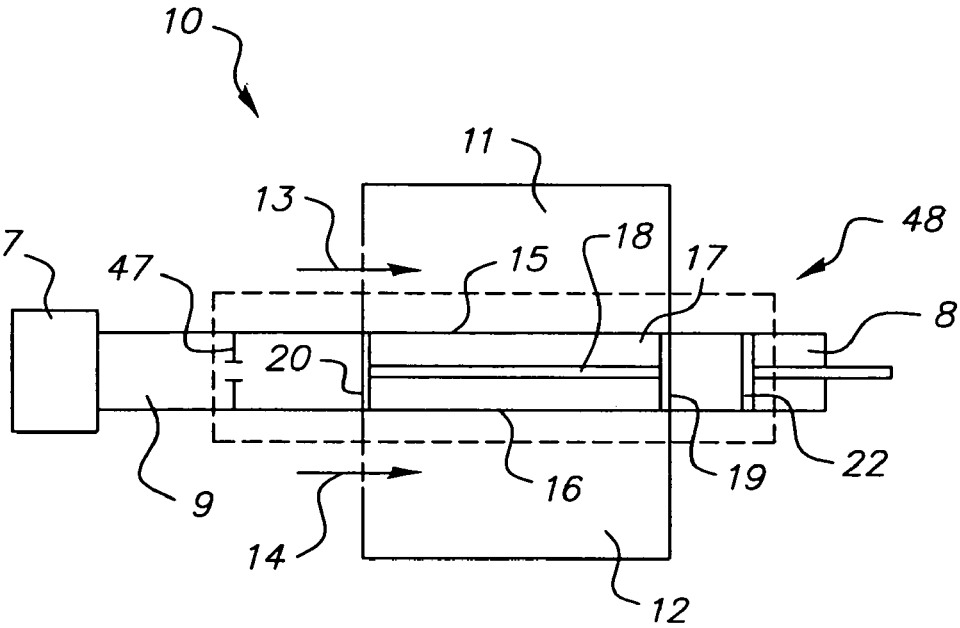
FIG. 3 is a section view along the line III, in FIG. 2, through the microwave mechanism at right angles to the paper track's direction of travel, showing a mechanism for generating a stream of air.

After passing through the microwave mechanism 5, the printing medium is conveyed through the cooling mechanism 2. FIG. 3 shows a cross section through a microwave mechanism 5 similar to the one shown in FIG. 1. In FIG. 2, the surface of the section is indicated by a line III. It runs at a 90° angle to the printing medium's direction of travel. The same reference numbers are used in both drawings.

Figure 4:
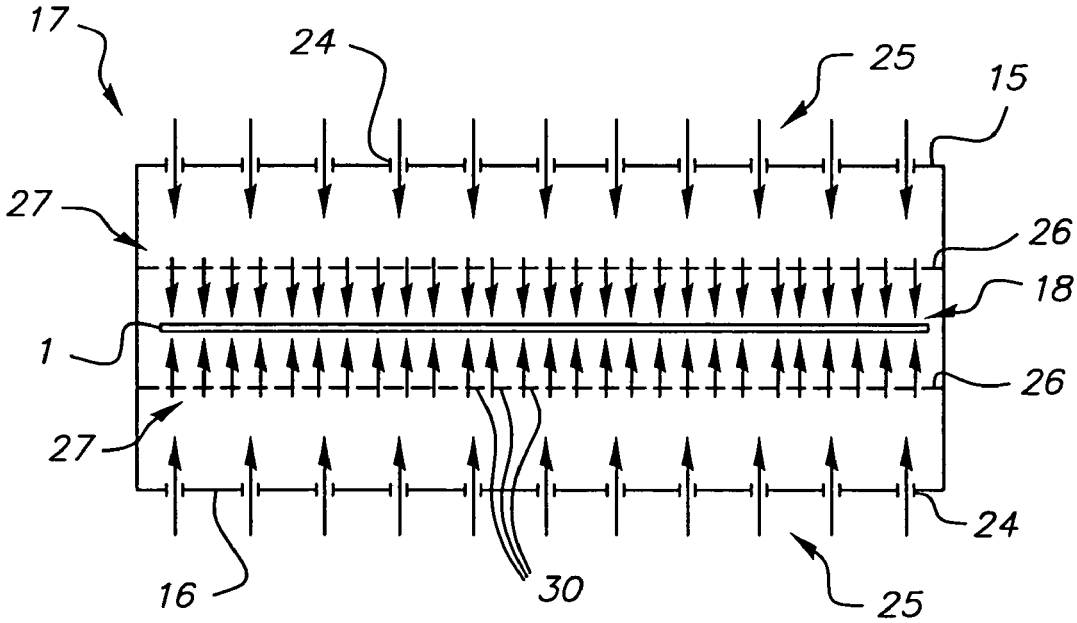
FIG. 4 is a representation of an application area of the microwave mechanism, showing a printing medium and air streams.

The inner space 10 of the microwave mechanism 5 is divided into two intake boxes 11 and 12, into which fans that are not shown here, blow air streams 13 and 14. The air inlet boxes 11 and 12 are mounted above and below the travel path of the printing medium 1. Here, they directly abut against the application area 17, whose walls 15 and 16 have air inlet openings 24 to the air inlet boxes 11 and 12. These air inlet openings 24 are shown in FIG. 4, and are slit-shaped in this embodiment.

Inside of the application area 17 a standing microwave field can be formed. The application area 17 is a component of an applicator 48. The applicator 48 extends from an inlet panel 47, through which the wave guide 9 feeds microwaves into the applicator 48 to a slide valve 22, located on the other side of the applicator 17. The applicator must meet the required limiting conditions for forming a standing microwave field. For this purpose, the slide valve 22 can be located in a sub-area 8 of the applicator 48. The slide valve 22 can be used to adjust the appropriate resonance conditions for the microwaves. When a standing wave forms in the applicator 48, it is also formed inside the application area 17, because this area is incorporated into the applicator 48.

The application area 17 incorporates the slot area 18 through which the travel path of the printing medium 1 runs. The slot area 18 is separated from the application area 17 by perforated PTFE sheets 26, as can be seen in FIG. 4.

Two PTFE walls 19 and 20 are enclosed inside the application area 17. They are intended to prevent the generated air streams from short-circuiting inside the application area 17. For this purpose, the walls 19 and 20 are located on the edges of the slot area 18 on the side of the wave guide 9, and also on the side of the sub-area 8, inside the application area 17. In the situation shown here, the walls 19 and 20 delimit the application area 17 and separate it spatially from the remaining area of the applicator 48. Accordingly, the sub-area 8, which is important with respect to providing resonance conditions, and the wave guide 9 are spatially separated from the application area 17. Between the wave guide 9 and the applicator 48, remains the inlet panel 47, which is responsible for coupling the microwave into the applicator 48.

An enlarged sketch of the application area 17 is shown in FIG. 4. Air streams 25 are brought into the inside of the application area 17 through air inlet openings 24 in the walls 15 and 16 of the application area 17.

The slot area 18 is separated from the remaining application area 17 by PTFE sheets 26. The PTFE sheets 26 are evenly perforated by tiny air holes 30. The air stream 25 is evenly brought into the inside of the slot area 18 through air holes 30, whereby a uniform and stable air stream 27 arises that removes moisture from the slot area 18 and at least supplementally supports conveyance of the printing medium 1. The printing medium 1 receives the impetus for its conveyance from the outside conveyor rollers 6, or from other conveyor elements not shown here.

Figure 5:
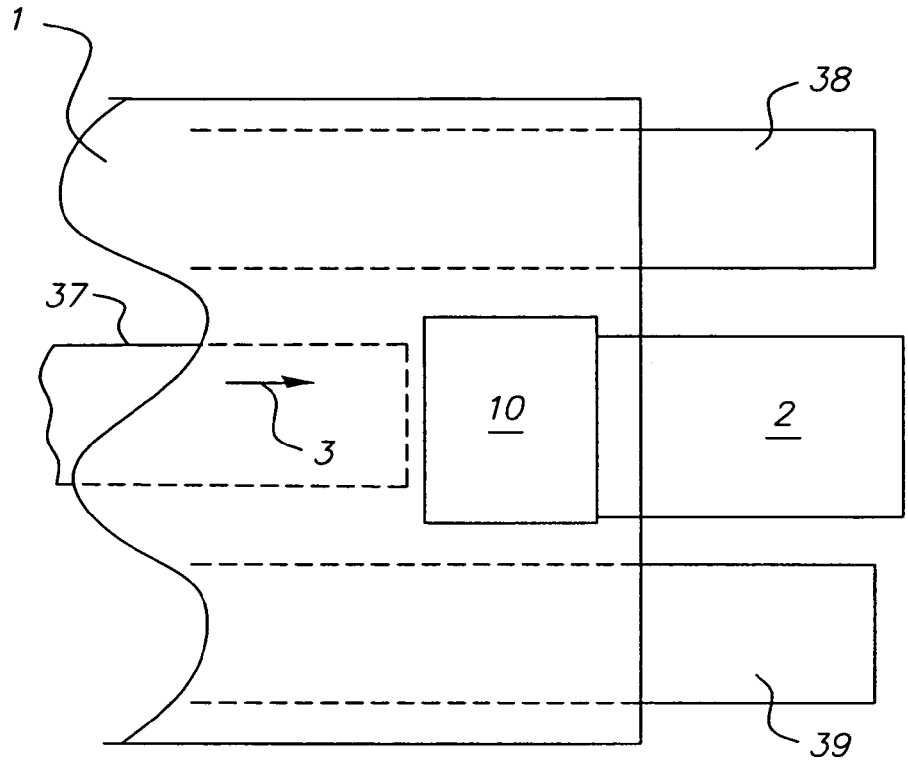
FIG. 5 is a view of a microwave mechanism for sheet paper.

FIG. 5 shows an overhead view of a microwave mechanism for sheet paper. The printing medium 1 here is a sheet of paper. Only the interior area 10 of the microwave mechanisms 5 is shown here. Based upon its extent, the application area 17 of the interior area 10 covers only a part of the printing medium. Consequently, two or more interior areas 10, or applicators 48, or microwave mechanisms 5 are arranged sequentially and displaced from one another so that the entire surface of the printing medium 1 is covered. These additional interior areas are not shown here. The benefit of this arrangement lies in the potential location of conveyor elements on the sides of the interior areas 10, which can then provide the impetus necessary to move the printing medium forward. An arrangement wherein several such applicators are displaced from one another is disclosed in aforementioned DE 101 45 005 A1.

The printing media 1 is conveyed in the direction of the arrow 3 through the interior space 10. For this purpose, the printing media 1 rides on several conveyor belts 37 through 39. The conveyor belt 37 lies directly in front of the interior space 10, and stops just short of this interior space 10. The two other conveyor belts 38 and 39 run parallel to the interior space 10 and a cooling mechanism 2, which lies downstream of the interior space 10. Inside the interior space 10 and the cooling mechanism 2, the printing medium 1 has no contact with a conveyor element.

An additional conveyor element (not shown here) can be located downstream of the cooling mechanism 2. This conveyor element can then support further conveyance of the printing medium.

When both sides of the printing medium 1 have been imprinted it is particularly necessary that it be cooled down to a low temperature. In this process, in order for the toner layers on both sides of the printing medium to become fused, both sides of the printing medium 1 are heated. An image imprinted on the bottom side of the printing medium would suffer damage if it came into contact with a conveyor belt, while at an overly high temperature. This required lower temperature can be 70° C. for example, and is attained by the end of the cooling of the mechanism 2.

Figure 6:
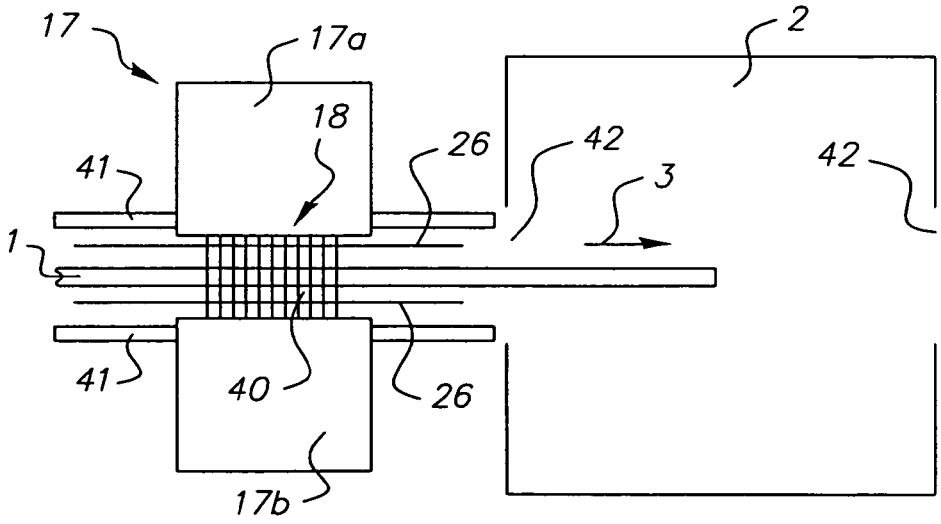
FIG. 6 is a side, schematic cross section through the microwave mechanism similar to the one shown in FIG. 5.

FIG. 6 schematically depicts a side view of a cross section through the microwave mechanism, as shown in FIG. 5. All that is shown of the interior space 10 is the application area 17 with the slot area 18. Air inlet boxes and air guides can be connected above, below, or on the side of the interior space 10. In particular, a wave guide 9 can guide the microwaves into the interior space 10 from above or below.

The application area 17, itself, is divided into an upper application area 17*a* that is located above the travel path, and a lower application area 17*b* that is located below the travel path. The printing medium 1 can then pass through the slot area 18 in the direction of the arrow 3. Inside the slot area 18, the microwave field 40 acts upon the printing medium. The representation of the microwave field 40, here, is purely symbolic and is not intended to indicate the actual energy distribution of the microwave field 40. Additional elements 41 can be located outside the microwave field 40 and in the immediate vicinity of the application area 17. These elements 41, for example, can reduce the amount of radiation that escapes.

The upper application area 17*a*, as well as the lower application area 17*b* are essentially open in the direction of the travel path, so that the microwave field 40 can be formed. The openings of both the upper application area 17*a* and the lower application area 17*b* are covered with PTFE sheeting, which prevents air from the slot area 18 from coming into application areas 17*a* and 17*b*. Guided air streams 27 can reach the slot area 18 via the application areas 17*a* and 17*b*, through PTFE sheets 26. These air streams 27 are not shown in this drawing, but they can be seen, specifically, in both FIG. 4 and FIG. 7.

The PTFE sheets 26 do not cover only the surfaces of the application area 17, but they also cover, at least partly, the additional elements 41. This way, air from the slot area 18, which could contain moisture, is prevented from getting into the applications areas 17*a* and 17*b*, where the water vapor could condense into water. Arcing or distortion of the microwave field 40 can thus be prevented.

After leaving the application area 17, the printing medium 1 runs through the cooling mechanism 2. The inlet and outlet openings 42 of the cooling mechanism 2 must not be as small as the slots 4 of the microwave mechanism 5. The elements 41 at the slot 4 must assure, to the greatest extent possible, that no microwave radiation escapes from the application area 17. The low height of the slot 4 presents a problem for the conveyance of the printing medium 1. If conveyance of the printing medium 1 is too uneven, the printing medium 1 can bump up against the edges of a slot 4, which can result in jamming or tilting of the printing medium 1 inside the microwave mechanism 5. Consequently, even inside the application area 17, conveyance of the printing medium 1 must be smooth and steady. The inlet and outlet openings 42 of the cooling mechanism 2 are of sufficient size to ensure that the printing medium 1 will not bump up against their edges.

As stated with reference to FIG. 5, the printing medium 1 is not propelled by contact-making conveyor elements inside either the application area 17 or the cooling mechanism 2. The printing medium 1 is both guided and propelled by conveyor elements that are not shown here, and are, for example, conveyor belts that are located downstream, upstream, or next to the application area 17 and the cooling mechanism 2.

Figure 7:
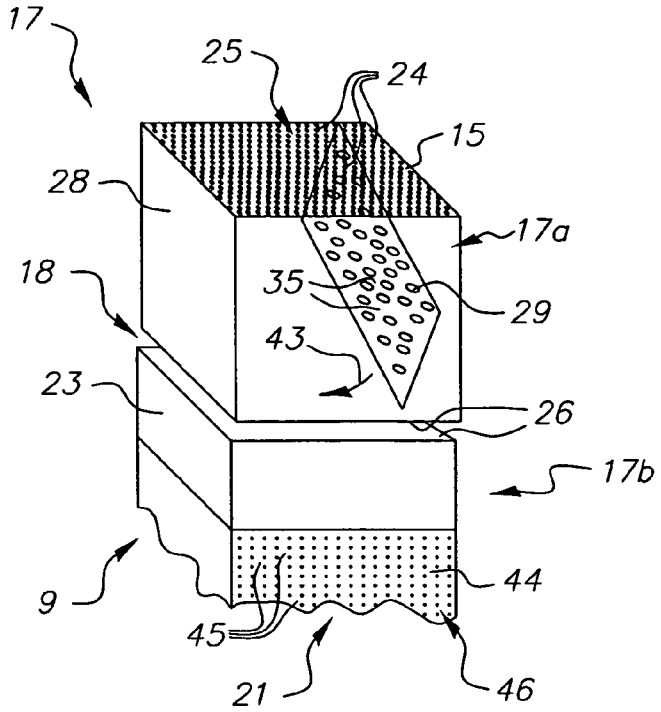
FIG. 7 is a representation of the structure of a mechanism for generating air streams, showing a supplemental microwave load.

FIG. 7 shows a representation of the structure of a mechanism for generating the air streams 25, 46, and 27, and a supplemental dielectric microwave load 29. For the sake of graphic simplicity, no representation of air streams 27 is shown here. This drawing shows in more detail the area shown in FIG. 5, where the air streams 27 act upon the printing medium 1. The printing medium 1 is not represented here for the sake of increased graphic simplicity.

The printing medium 1 can be conveyed here through the slot area 18. The slot area 18 is located between the upper and lower application areas 17*a* and 17*b*. In the structures shown here, the air inlet boxes 11 and 12 are not shown. Air streams 25 and 46 are directed into the interior of the application area 17 through air inlet holes 24 and 45, located in the walls 15 of the application area 17*a*, and the wall 44 of the air guide 9.

The air stream 46 is directed from the air guide 9 into the lower application area 17*b* through an inlet panel, not shown here. An air inlet box 11, not shown here, is located above the travel path and connects to the wall 15 of the application area 17*a*. A second air inlet box 12, also not shown here, is located below the path of travel and connects to the wall 44 of the air guide 9. In the arrangement shown here, it is located on the side of the air guide 9.

In the arrangement represented here, the microwaves are being directed in the direction shown by the arrow 21 into the application area 17 through the wave guide 9, whereby they pass through the inlet panel, not shown here, but located between the wave guide 9 and the application area 17.

An air stream 46 can be directed into the interior of the wave guide 9 via the air inlet openings 45, located in a certain area of the wall 44. This air stream 46 is further directed into the application area 17*b*. The certain area of the wall 44 of the wave guide 9 which contains the air inlet openings 45, does not need to extend over the entire wall 44 of the wave guide 9. Such an area is sufficiently large if it can assure an adequate air stream 46 for achieving the desired effects, such as removal of moisture from the application area and support of the conveyance of the printing medium.

An air stream 25 can likewise be brought into the application area 17*a* above the travel path of the printing medium 1 via the air inlet slit 24 on the wall 15. The air streams 25 and 46, which are brought into the interior of the application area 17 through the air inlet slots 24 and 45, bombard the PTFE sheets 26, which separate the slot area 18 from the remaining application area 17. The air streams, 25 and 46, can be directed by the perforated PTFE sheet 26, so that it can be made possible for the air stream 27 that has been thus generated to remove moisture that is released by the printing medium. In addition, conveyance of the printing medium 1 through the microwave mechanism 5 can, at least, be supported so that it runs smoothly and evenly, thus preventing jamming caused by warping or tilting of the printing medium 1.

There is no pressing necessity for air inlet boxes to be located outside the walls 15 and 44. It can also be possible for direct fans, which bring air into the application area 17, or into the wave guide 9 of the microwave mechanism 5 to be emplaced. Inside the application area 17 or in the area of the wave guide 9, air streams 25 and 46 are generated via the air inlet slots 24 and 45. Then, air streams 27 are generated via the holes 30 in the perforated PTFE sheets 26.

These routes traversed by the air streams 25 and/or 46 and 27, essentially represent air channels inside the application area 17. They have air outlet openings such as the holes 30, through which conveyance of the printing media 1 can at least, be supported. Moisture can be removed from the microwave mechanism 5 by the guided air streams 25, 46, and 27.

In the embodiment shown here, a load 29 has been additionally integrated into the application area 17 of the microwave mechanism 5. The applicator's resonance conditions for the various printing media 1 can be adjusted by a process involving the load 29. For this purpose, the load 29 can be tipped in the direction of the arrow 43 into the areas within the application area 17 that have greater field strengths. In order to allow an air stream to pass through this load 29, provision is made for the load 29 to have air passage holes 35 that do not significantly obstruct the air stream.

Figure 8:
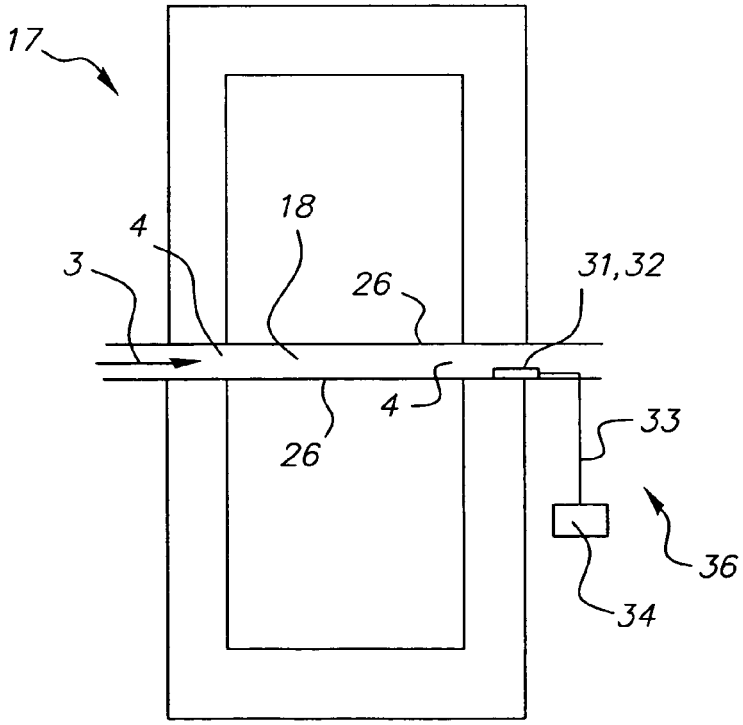
FIG. 8 is a cross section of an applicator area similar to the one shown in FIG. 5 or FIG. 7, showing a device for measuring humidity.
Figure 9:
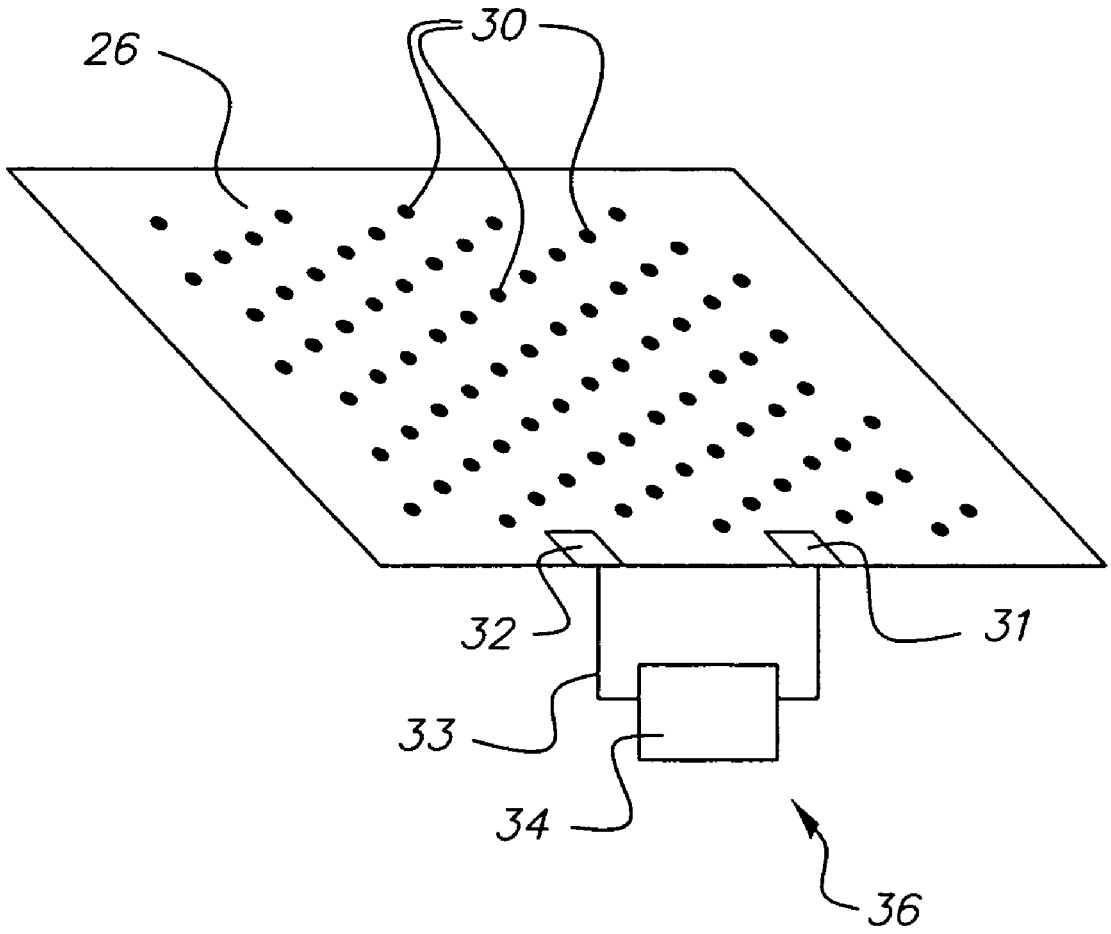
FIG. 9 is an oblique view of a PTFE sheet, showing a device for measuring humidity.

FIG. 8 shows a cross section through the application area 17 similar to that shown in FIG. 5 and FIG. 7, along with a moisture-measuring device 36. FIG. 9 shows an oblique view of a PTFE sheet 26, along with a moisture-measuring device. Attached to the PTFE sheet 26 are two electrodes 31 and 32. The points of attachment should be in the area of a low field strength and should not cover up any air holes 30. For this purpose, the most suitable place for the printing medium is in the entry area, or preferably in the exit area, where it passes through the slot area 18; that means in the direction 3 of the travel of the printing medium 1. Caution must be taken that the electrodes 31 and 32 do not extend into the microwave field 40 of the applicator 48.

The two electrodes, 31 and 32 are connected by leads 33, with a measurement and control unit 34. The measurement and control unit 34 applies a high voltage pulse to the electrodes 31 and 32, and the current between the two electrodes is measured. If there is no water between the electrodes 31 and 32, there should be no flow of current. If, however, water has condensed onto this area, a current will be detectable. Such water would then to have been removed from the slot area 18 to the vicinity of the electrodes 31 and 32. Since this water was first detected inside the slot area 18, the amount of condensed water between the electrodes provides at least, an indirect indication of the condition inside the slot area 18. The more condensed water that is present, the more moisture must be present inside the slot area 18. The current that is measured directly correlates to the amount of condensed water, thus indirectly providing data concerning the moisture in the interior of the slot area 18. When no moisture is present inside the application area 17 or the slot area 18, no current should flow. However, if current does flow, the amount of current flow is a measure of the prevailing moisture. The two electrodes 31 and 32 must not protrude into the interior of the application area 17 where their presence would otherwise adversely affect the existing microwave field.

A printing medium 1 is conveyed on a conveyor belt 2. The printing medium 1 can be a sheet of paper, for example, that has received a layer of toner from an inking device inside a printing machine. This layer of toner must be fused onto the printing medium 1. The printing medium 1 is then conveyed into the microwave mechanism 5. Here, the toner and the printing medium are heated to the point where the toner becomes fused onto the printing medium 1. To avoid arcing and distortions of the microwave field 40 inside the applicator 48 of the microwave mechanism 5, air streams 27 are generated inside the microwave mechanism 5. Moisture can then be removed by these air streams and in addition, the printing medium 1 can be conveyed in a contact-free method inside the microwave mechanism 5.

The actual momentum of the printing medium 1 is provided by conveying elements located outside the microwave mechanism 5 and the cooling mechanism 2. In the case of rolled paper, this element can be the rollers 6 and in the case of sheet paper, the elements can be conveyor belts 37, 38, and 39, and/or other elements, not shown in the drawings. These conveyor belts are located next to, upstream of and downstream of the microwave mechanism 5 and the cooling mechanism 2.

The air stream 27 is generated, in that air streams 13 and 14 are blown into air inlet boxes 11 and 12 by fans that are not shown here. These boxes are configured so that the air is further directed through air inlet openings and into the application area 17, where air streams 25 are generated. Embodiments that do not incorporate air inlet boxes are also conceivable. The air inlet boxes 24 are such that escape of microwave radiation from the application area 17 is precluded, while simultaneously, sufficient air can flow into this area. The air inlet openings, for example, can be 2 mm×14 mm slits that are at right angles to the microwaves' direction of propagation in the application area 17. During experiments conducted in accordance with a TE10N applicator, this arrangement resulted in no significant reflected radiation. Round air inlet openings 24 are also feasible.

Beamed air streams 25 can be generated in the inside of the application area 17 in the manner described. In order for the conveyance of the printing medium 1 inside the slot area 18 to be smoothly and steadily supported, in addition to removing moisture from the application area 17, these air streams 25 are further directed through the air holes 30 in the perforated PTFE sheets 26. The resulting uniform impingement of the air stream 27 against the printing medium 1 not only stabilize conveyance of the printing medium, but because of its uniformity, also assures that moisture is removed from every point on the surface of the printing medium and is conveyed out of the application area 17. The size of these air holes 30 and their distribution in PTFE sheets 26 is selected so that sufficient air is allowed to go through to build a stable air cushion. The PTFE sheets 26 in the situation presented here are 0.1 mm thick. They are placed directly on the walls of the application area 17 in the interior of the microwave mechanism 5, but can also extend beyond, as shown specifically in FIG. 5. Accordingly, air streams 27 are directed at the printing medium 1.

Since the arrangement and holing or slitting of the PTFE sheets 26, or the walls 15 and 16 of the application area 17 do not change, the air streams 27 that are responsible for the removal of moisture and for forming the air cushion in the slot area 18 can be adjusted directly by the air streams 13 and 14 that are blown by fans into the air inlet boxes 11 and 12. In particular, it is possible to specifically adjust the air streams 27 for different kinds of printing medium. The material characteristics of the printing medium including its weight can be taken into consideration in this regard. For example, sheet paper with higher gram weights requires stronger air streams 27. The type of printing medium is also important with respect to the moisture released therefrom. Consequently, foil releases less water than coated paper, which in turn releases less water than uncoated paper. The more water that is released, the faster the air streams 27 must be. The weights of the printing media being used are normally known in advance, and the pertinent data is available electronically. This information can be evaluated in data processing mechanisms that are not shown here and can be used to automatically control the air streams 27. Specifically, caution can be taken that the air streams 27 are controlled as a function of direction, depending upon whether they act from above or below the travel path.

The air streams 27 leave the inner space 10 of the microwave mechanism via the slot 4. The printing medium 1 is heated by the microwaves, as is the toner that is on the printing medium, which is specifically heated by the printing medium 1. In particular, water that is in the printing medium is heated and is partially released as water vapor. This water vapor can condense inside the microwave mechanism 5, distort the microwave field, and/or cause arcing. The air streams 27 absorb water vapor and depart the microwave mechanism 5 carrying this water vapor, contributing to a dry atmosphere in the inner space 10 and the application area 17 of the microwave mechanism 5.

To increase the ability of the air streams 27 to absorb moisture, provision has been made for the air streams 13 and 14, which are directed toward the air inlet boxes 11 and 12 to be heated before they reach the boxes or even inside the air inlet boxes 11 and 12. For this purpose it can be possible, in particular, for the air streams 13 and 14 to be preheated by waste heat from the microwave mechanism 5 or the printing machine that is not shown here, in order to save energy.

As already shown in FIG. 7, the air streams 25 do not have to emanate from air inlet boxes that are only located above or below the travel path. Here, an air stream 46 is brought into the wave guide 9 and then directed into the application area 17*b* via an inlet panel, then directed further upwards into the slot area 18. On the other side, another air stream 25 is generated directly on an upper wall 15 of the application area 17*a*, and is then directed downwards. The PTFE sheets 25 are emplaced as stated above, inside the application area 17, and can extend beyond this area. The formation of the air cushion as well as the removal of moisture, are accomplished here, in the same manner as described above.

In order to allow a better reaction to any increase in moisture inside the application area 17, at least one PTFE sheet 26 has a moisture-measuring device. High voltage pulses are applied to two electrodes 31 and 32. Since the Teflon foil is not conductive, no measurable current should flow between the electrodes. When more moisture is released in the applicator 48 or in the application area 17, more moisture is deposited on the Teflon foil 25, thus increasing its conductivity. The current between the electrodes 31 and 32 that results from this increased conductivity and the high voltage pulses, can be detected by the moisture-measuring device 36. This current is evaluated by the measurement and control unit 34. An appropriate reaction to the values measured is therefore possible. Moisture removal on the part of the air streams 27 can then be automatically increased.

There are two ways in which this can be accomplished. First, the velocity of the air streams 27 can be increased. To achieve this purpose, the quantity of air that is brought by the air streams 13 and 14 into the air inlet boxes 11 and 12 can be increased. The quantity of air must, of course, not exceed a pre-determined maximum, because otherwise, stable support for the conveyance of the printing medium 1 through the microwave mechanism 5 can no longer be assured. If raising the quantity of air within these limits does not suffice for adequate removal of moisture, there is still a possibility of further heating the air that is directed into the inner space 10 or the application area 17 of the microwave mechanism 5. To achieve this purpose, provision can be made for additional heat sources that are not shown here, but would be located in the vicinity of the air inlet boxes 11 and 12 or directly in the area of the fans (also not shown here), but are located inside the air inlet boxes 11 and 12.

The necessary quantity of air or the heat required for heating the air can be automatically adjusted by a control system, not shown here. This system would receive the necessary data concerning the quantity of moisture in the application area 17 from the moisture-measuring device 36.

Accordingly, a technologically feasible level of humidity can be maintained inside the microwave mechanism 5. This can prevent the occurrence of damage inside the microwave mechanism 5. Arcing and distortion of the microwave field 40 inside the applicator 48 that are caused by condensed water will be prevented. For this reason separation of the slot area 18 from the remaining application area 17 by the PTFE sheets 26 is beneficial, because then essentially no moisture can be conveyed into the remaining area of the application area 17.

A printing medium 1 can be conveyed in a contact-free method, through the microwave mechanism 5 by an air cushion generated by the air streams 27. Toner on either side of the printing medium 1 will therefore, not be smeared by contacts made inside the application area 17. Paper jams or tilting of the printing medium 1 inside the application area 17 can be prevented by a stable conveyance.

The invention has been described in detail with particular reference to certain preferred embodiments thereof, but it will be understood that variations and modifications can be effected within the spirit and scope of the invention.

What is claimed is:

1. A process for handling a printing medium (1) in a microwave mechanism (5), of a printing machine, comprising the steps of: removing moisture from the microwave mechanism (5), and conveying the printing medium (1) by supporting the printing medium (1) by flowing air prevented from flowing out of a slot area (18) that is used to convey the printing medium (1) through the microwave mechanism (5) and into an application area (17) that incorporates the slot area (18), the air being heated by energy dissipated by the microwave mechanism (5) before it flows into the microwave mechanism (5), the temperature of the air being adjusted automatically, in particular, as a function of the measured level of moisture and the velocity of the air stream.

2. A process according to claim 1, wherein the moisture content inside the microwave mechanism (5) is determined, preferably in the vicinity of a travel path of the printing medium (1).

3. A process according to claim 1, wherein the velocity of the air flow is automatically adjusted, in particular, as a function of the temperature of the flowing air, the measured moisture, the type of printing medium (1), and the weight of the printing medium (1).

4. An apparatus for handling a printing medium (1), that includes a microwave mechanism (5) for a printing machine, including a slot area (18) that is used for conveying the printing medium (1) along a travel path through an application area (17), comprising: a dielectric load (29), located in the microwave mechanism (5), said dielectric load containing air passage holes (35) that make the passage of flowing air possible, and sheets (26) that at least partially seal off said slot area (18), said sheets being made of a material that either does not absorb microwaves or does so only to a slight degree, said sheets being preferably located in the vicinity above and below the travel path of the printing medium (1).

5. An apparatus according to claim 4, wherein said sheets (26) at least partially seal off an area that extends beyond the application area (17) and that incorporates the application area (17).

6. An apparatus according to claim 4, wherein said sheets (26) that at least partially seal off said slot area (18) are perforated for the purpose of guiding flowing air.

7. An apparatus according to claim 4, wherein said material of sheets that do not absorb microwaves is PTFE.

8. An apparatus according to claim 4, wherein the apparatus further incorporates air inlet boxes (11 and 12), preferably below and above the application area (17).

9. An apparatus according to claim 4, wherein walls (15 and 16) of said application area (17) contain air inlet openings (24).

10. An apparatus according to claim 9, wherein said air inlet openings (24) have a geometry to prevent or minimize the escape of microwave radiation.

11. An apparatus according to claim 4, further including at least one air barrier (19 and 20) preferably made of PTFE, and said at least one air barrier (19 and 20) separates a slot area (18) inside the application area (17) that is used to pass the printing medium (1) through the application area (17) from the remaining applicator (48).

12. An apparatus according to claim 4, further including a device for measuring moisture (36) that is located in the vicinity of the microwave mechanism (5).

13. An apparatus according to claim 12, wherein said device for measuring moisture (36) contains at least two electrodes (31 and 32) located on a nonconductive surface, preferably on one of the sheets (26).

14. An apparatus according to claim 4, further including, at least one preheating mechanism for preheating incoming air.

* * * * *